US005398506A

United States Patent [19]

Martin

[11] Patent Number: 5,398,506

[45] Date of Patent: Mar. 21, 1995

[54] CONTROL SYSTEM FOR HYDRAULIC PUMP SYSTEM

[75] Inventor: John C. Martin, Toronto, Canada

[73] Assignee: Diesel Equipment Limited, Ontario, Canada

[21] Appl. No.: 231,064

[22] Filed: Apr. 22, 1994

[51] Int. Cl.[6] ..... F16D 31/02; F04B 35/04

[52] U.S. Cl. ..... 60/433; 417/316

[58] Field of Search ..... 60/431, 432, 433, 434, 60/481; 417/316, 317

[56] References Cited

U.S. PATENT DOCUMENTS

| | | | |
|---|---|---|---|
| 2,219,359 | 10/1940 | Goit et al. | 417/316 |
| 2,517,527 | 8/1950 | Moore | 60/431 X |
| 2,690,712 | 10/1954 | Foote | 60/431 X |
| 4,056,160 | 11/1977 | Abels et al. | 60/431 X |
| 4,881,371 | 11/1989 | Haeder et al. | 60/431 |

*Primary Examiner*—Edward K. Look
*Assistant Examiner*—John Ryznic
*Attorney, Agent, or Firm*—Oliff & Berridge

[57] ABSTRACT

Electrically operated hydraulic pump systems are commonly used on tailgate loaders and small dump truck hoists. The systems include a switch which, when closed, couples the vehicle battery to the pump driving motor and a hydraulic lowering valve which, when opened, drains the output port of the pump to a reservoir. The control system for this electric pump system comprises an air cylinder operatively connected to the switch and a second cylinder operatively connected to the hydraulic lowering valve. A switching valve is connected between each air cylinder and a source of air pressure. The switching valves may be operated by an operator to pump or drain hydraulic fluid.

10 Claims, 2 Drawing Sheets

CONTROL SYSTEM FOR HYDRAULIC PUMP SYSTEM

BACKGROUND OF THE INVENTION

1. Field of the Invention

This invention relates to apparatus for controlling an hydraulic pump system.

2. Description of the Related Art

Electrically powered hydraulic pump systems are commonly used on tailgate loaders and small dump truck hoists. One reason for this is that a small transmission may not support a power take-off opening. Another reason is that the operation of the hydraulic pump may be required when the prime mover is not running. These electrical pump systems use the twelve volt vehicle electrical battery for power and for control.

Known systems rely on a low current solenoid to engage a high current switch between the battery and an electric motor which drives the pump. A second such solenoid is used to open an hydraulic lowering valve. The solenoids have a spring return for opening the switch between battery and motor and closing the hydraulic lowering valve.

The solenoids, valve, and switch operate in a very hostile environment containing significant amounts of water and salt. This increases the maintenance requirements for the solenoids and also suggests a solenoid design which maximizes the actuating force provided to better ensure reliable operation. However, a higher power solenoid results in large current drains and high heat in the solenoid windings. And even so, the forces available from twelve volt solenoids are relatively low. To lower the force requirements for the hydraulic lowering valve, it is known to use a pilot valve or a small orifice valve. Unfortunately, this solution results in valves that are extremely sensitive to dirt and moisture, especially in cold temperatures when moisture droplets can freeze.

This invention seeks to provide a reliable and robust hydraulic pump system.

SUMMARY OF THE INVENTION

According to the present invention, there is provided apparatus for controlling an hydraulic pump system of the type having an hydraulic pump with an output port, a reservoir of hydraulic fluid, a driving means for driving said pump to pump hydraulic fluid from said reservoir to said output port, a switch having an operative position whereat said driving means drives said pump and an inoperative position whereat said driving means does not drive said pump, and an hydraulic lowering valve operatively connected to said output port for porting hydraulic fluid from said output port to said reservoir, said control apparatus comprising: a first air cylinder having a piston rod adapted for operative coupling to said switch; first switchable air valve means adapted for operative connection to said first air cylinder, said first air valve means for connection to a source of air pressure; a second air cylinder having a piston rod adapted for operative coupling to said hydraulic lowering valve; a second switchable air valve means adapted for operative connection to said second air cylinder, said second air valve means for connection to said source of air pressure, whereby, in use, said first switchable air valve may be switched in order to operate said switch and said second switchable air valve may be switched to operate said hydraulic lowering valve.

DETAILED DESCRIPTION OF THE PREFERRED EMBODIMENT

Figure 1:
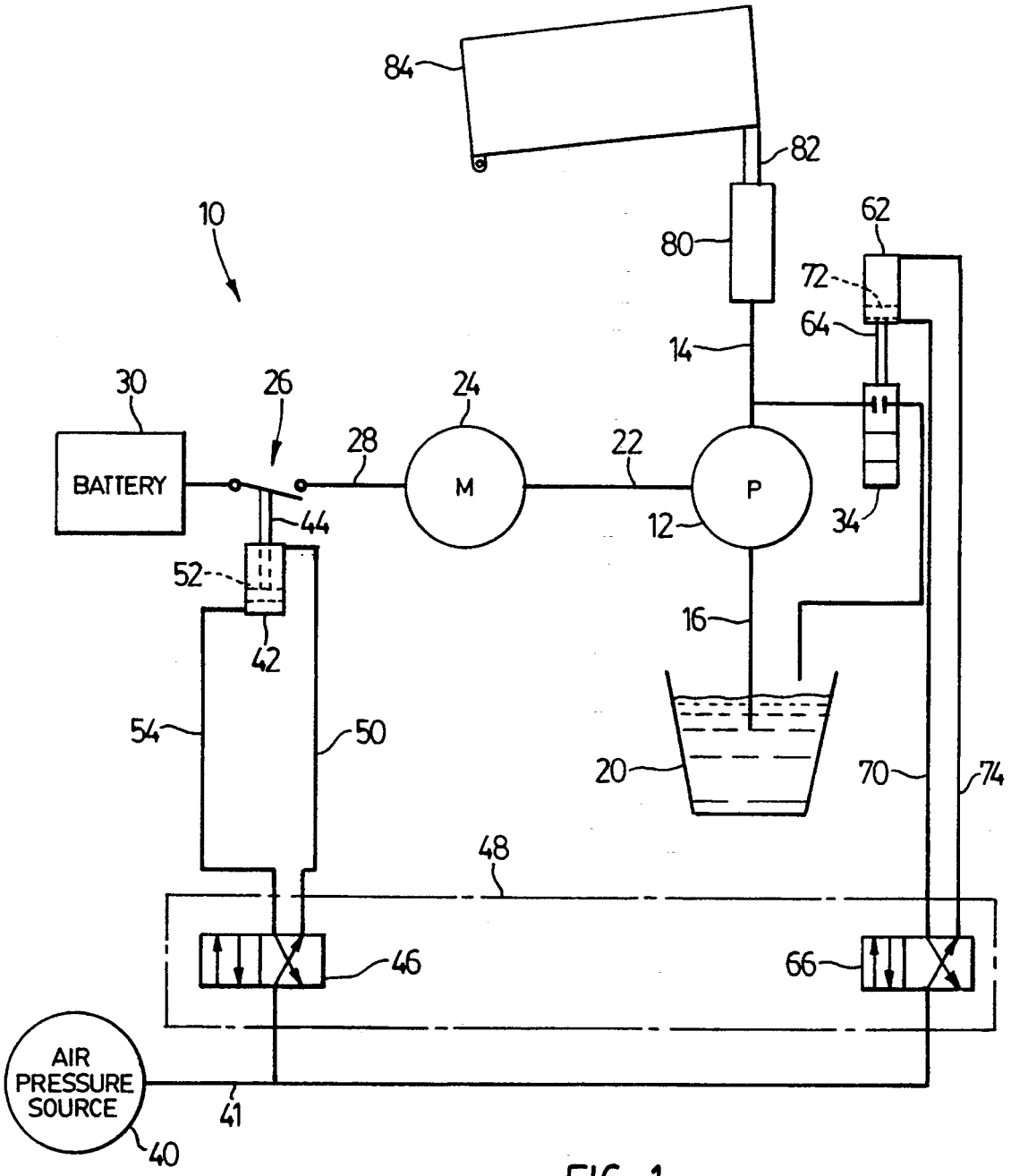
FIG. 1 is a schematic illustration of an hydraulic pump system including the control system of this invention.

With reference to FIG. 1, an hydraulic pump system 10 comprises an hydraulic pump 12 with an output port 14. The pump has an input line 16 extending from a reservoir of hydraulic fluid 20. A driving means in the nature of motor 24 has a drive shaft 22 operatively connected to the pump for driving the pump to pump hydraulic fluid from the reservoir to the output port. A switch 26 is interposed in a line 28 between battery 30 and motor 24. An hydraulic lowering valve 34 is connected between output port 14 of pump 12 and reservoir 20.

The control system for the hydraulic pump system includes a source 40 of air pressure, air cylinders 42, 62, and two-way switchable valves 46, 66 in an operator control panel 48. Air cylinder 42 has a piston 52 with a piston rod 44 connected to switch 26. Two-way switchable valve 46 is connected between air cylinder 42 and the air pressure source 40. More particularly, one output line 50 from valve 46 extends to one side of piston 52 of air cylinder 42 and a second output line 54 from valve 46 extends to the other side of piston 52. Valve 46 may be manipulated by an operator to connect one of lines 50 and 54 to line 41 from the air pressure source and the other to a vent 57.

A second air cylinder 62 has a piston 72 with a piston rod 64 operatively coupled to hydraulic valve 34. Two-way switchable air valve 66 is connected between air cylinder 62 and the air pressure source 40. In particular, output line 70 from valve 66 extends to one side of piston 72 of air cylinder 62 and output line 74 extends to the other side of the air cylinder. Valve 66 may be manipulated to connect one of these output lines to the air pressure source and the other to a vent.

Output port 14 of pump 12 is connected to an hydraulic cylinder 80 with a piston rod 82 connected to a dump truck box 84.

In operation, with valve 46 and of valve 66 in the position shown in FIG. 1, pump 12 is deactivated and hydraulic lowering valve 34 is closed. This then is the neutral position whereat the dump body is held in position.

In order to raise dump truck box 84, an operator may manipulate valve 46 to its second position such that output line 54 of the valve 46 connects air pressure source 40 to the back of piston 52 of air cylinder 42 and output line 50 is vented. This causes the piston rod 44 to extend and move switch 26 from its inoperative, open, position shown in the figure to a closed, operative, position whereat battery 30 is connected to motor 24. As a result, motor 24 is activated so that its output shaft 22 drives pump 12 to pump hydraulic fluid from reservoir 20 to hydraulic cylinder 80. This extends piston rod 82 thereby raising dump truck box 84. While this operation is occurring, valve 66 is left in the FIG. 1 position such that hydraulic lowering valve 34 remains closed. Once dump truck box 84 has been raised as desired, valve 46 is switched back to its FIG. 1 position thereby causing piston rod 44 to retract and open switch 26. The hydraulic pump system is thereby returned to its neutral position.

In order to lower dump truck box 84, valve 66 may be switched to its second position whereby output line 70 of valve 66 connects air pressure source 40 to air cylinder 62. This causes piston 64 to retract and open valve 33 thereby connecting output port 14 of pump 12 to reservoir 20. Once the dump truck box has been lowered as desired, valve element 76 may be returned to its position illustrated in FIG. 1.

Much greater force is available through the subject control system than would be available if the control system relied upon battery 30, which is normally only a twelve volt battery. Further, the air cylinders of this invention are powered to extend and powered to retract, which insures reliable operation even in a hostile environment.

Figure 2:
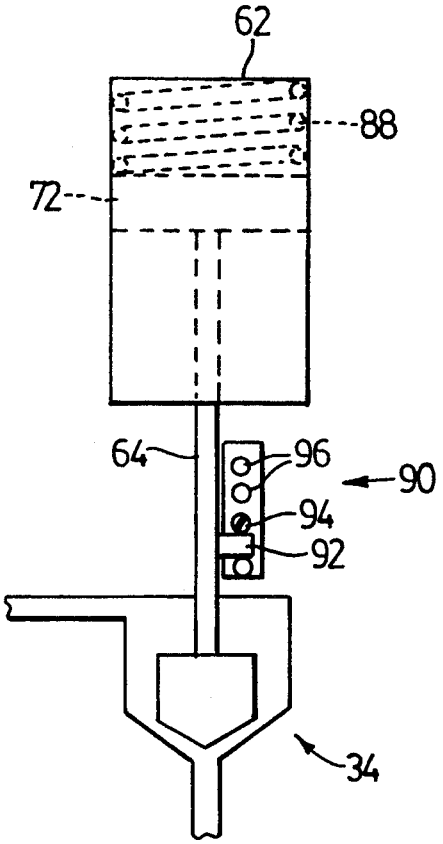
FIG. 2 is a schematic view of a portion of an alternate hydraulic pump system made in accordance with this invention, and, FIG. 3 is a schematic illustration of a portion of the hydraulic pump system of FIG. 1 illustrating a further modification.

A modification is illustrated in FIG. 2. Turning to this figure, air cylinder 62 is provided with spring 88 which biases the piston 72 of the air cylinder so that valve 44 is closed. In this embodiment, air cylinder 42 would be biased to a retracted position whereat switch 26 was open. Thus, this modification biases the control system to a neutral position. This modification is appropriate where the air pressure source is not continuously operative as it keeps the box in position when the air pressure is not connected.

FIG. 2 also illustrates an adjustable stop 90 for valve 34. In particular, a tab 92 on piston rod 64 abuts stop pin 94 when piston 72 of cylinder 62 is retracted in order to limit the amount valve 34 may be opened. Pin 94 may be inserted in any of pin receptors 96 in order to adjust the stop position for valve 34. In this way, the flow way through valve 34 may be controlled in order pre-select the rate of descent of the dump truck box.

Figure 3:
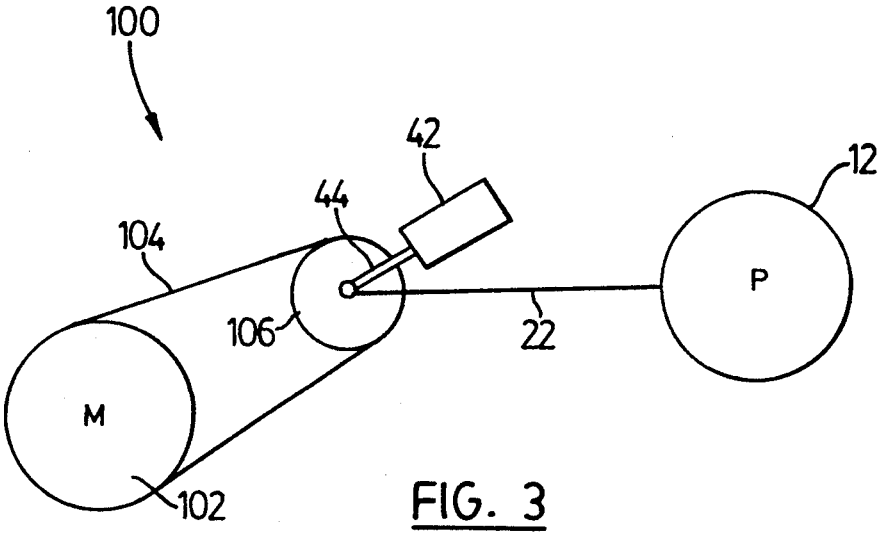

FIG. 3 illustrates a portion of a modified hydraulic pump system 100. In this modified system a prime mover 102 has a belt 104 connected to slip clutch 106. The piston rod of air cylinder 42 may retract in order to engage clutch 106 to drive shaft 22 and, therefore, pump 12. When piston rod 44 of air cylinder 42 is extended, the clutch is no longer engaged, and drive shaft 22 is not driven.

Hydraulic pump system 10 may operate equipment other than a dump truck box, such as a snow plough blade or a tailgate loader. It will be apparent that the hydraulic pump systems disclosed provide robust, reliable pump control utilizing a different design philosophy from prior systems.

Other modifications will be apparent to those skilled in the art and, therefore, the invention is defined in the claims.

What is claimed is:

1. Apparatus for controlling hydraulic pump system of the type having hydraulic pump with an output port, a reservoir of hydraulic fluid, a driving means for driving said pump to pump hydraulic fluid from said reservoir to said output port, a switch having an operative position whereat said driving means drives said pump and an inoperative position whereat said driving means does not drive said pump, and hydraulic lowering valve operatively connected to said output port for porting hydraulic fluid from said output port to said reservoir, said control apparatus comprising:

a first air cylinder having a piston rod adapted for operative coupling to said switch;

first switchable air valve means adapted for operative connection to said first air cylinder, said first air valve means for connection to a source of air pressure;

a second air cylinder having a piston rod adapted for operative coupling to said hydraulic lowering valve;

a second switchable air valve means adapted for operative connection to said second air cylinder, said second air valve means for connection to said source of air pressure, whereby, in use, said first switchable air valve may be switched in order to operate said switch and said second switchable air valve may be switched to operate said hydraulic lowering valve.

2. The apparatus of claim 1 wherein said first switchable air valve has a first position for communicating air to said first air cylinder to retract said piston rod and a second position for communicating air to said first air cylinder to extend said piston rod.

3. The apparatus of claim 2 wherein said second switchable air valve has a first position for communicating air to said second air cylinder to retract said piston rod and a second position for communicating air to said second air cylinder to extend said piston rod.

4. An hydraulic pump system comprising:

an hydraulic pump with an output port;

a reservoir of hydraulic fluid;

a driving means for driving said pump to pump hydraulic fluid from said reservoir to said output port;

a switch having an operative position whereat said driving means drives said pump and an inoperative position whereat said driving means does not drive said pump;

an hydraulic lowering valve operatively connected to said output port for porting hydraulic fluid from said output port to said reservoir;

a source for providing air pressure;

a first air cylinder having a piston rod operatively coupled to said switch;

first switchable air valve means operatively connected between said first air cylinder and said source for air pressure;

a second air cylinder having a piston rod operatively coupled to said hydraulic lowering valve;

a second switchable air valve means operatively connected between said second air cylinder and said source for air pressure, whereby said first switchable air valve may be switched in order to operate said switch and said second switchable air valve may be switched in order to operate said hydraulic lowering valve.

5. The system of claim 4 wherein said first switchable air valve has a first position wherein it communicates air to said first air cylinder to retract said piston rod and a second position whereat it communicates air to said first air cylinder to extend said piston rod.

6. The system of claim 5 wherein said second switchable air valve has a first position wherein it communicates air to said second air cylinder to retract said piston rod and a second position whereat it communicates air to said second air cylinder to extend said piston rod.

7. The system of claim 6 wherein said hydraulic lowering valve comprises an adjustable stop for limiting the opening of said hydraulic lowering valve.

8. The system of claim 6 including a battery and wherein said drive means comprises an electric motor connected to said battery through said switch.

9. The system of claim 6 including a prime mover and wherein said drive means comprises a clutch and said switch is for selectively engaging said clutch with said prime mover.

10. The system of claim 6 wherein said output port is connected to an hydraulic cylinder.

* * * * *

UNITED STATES PATENT AND TRADEMARK OFFICE

CERTIFICATE OF CORRECTION

PATENT NO. : 5,398,506

DATED : March 21, 1995

INVENTOR(S) : John C. Martin

It is certified that error appears in the above-identified patent and that said Letters Patent are hereby corrected as shown below:

column 2, line 40, delete "57";

column 2, line 53, delete "of";

column 3, line 13, delete "33" and insert --34--;

column 3, line 60, insert --an-- before the word "hydraulic";

column 3, line 61, insert --an-- before the word "hydraulic";

column 3, line 67, insert --an-- before the word "hydraulic".

Signed and Sealed this

Thirtieth Day of May, 1995

Bruce Lehman

*Attest:*

BRUCE LEHMAN

*Attesting Officer*

*Commissioner of Patents and Trademarks*